United States Patent [19]

Cassimally

[11] 3,960,252

[45] June 1, 1976

[54] COLLAPSIBLE TROLLEY AND PORTABLE CASE

[76] Inventor: Khalil Ahmad Ibrahim Cassimally, 210-Third St. West, Roundup, Mont. 59072

[22] Filed: May 31, 1974

[21] Appl. No.: 474,546

[52] U.S. Cl. ..... 190/18 A; 280/37

[51] Int. Cl.[2] ..... B65D 5/14

[58] Field of Search ..... 280/36 C, 37, 38, 41 C, 280/41 B, 30, 47.13 R, 47.17, 43.1; 190/18 A, 15.1, 1

[56] References Cited

UNITED STATES PATENTS

| | | | |
|---|---|---|---|
| 1,028,178 | 6/1912 | Batchelor | 280/37 |
| 2,463,713 | 3/1949 | Partiot | 280/37 |
| 2,562,686 | 7/1951 | Altemus | 280/38 |
| 2,581,417 | 1/1952 | Jones | 280/38 |
| 2,733,076 | 1/1956 | Burnett | 280/36 C |
| 3,709,513 | 1/1973 | Cassimally | 280/37 |
| 3,810,649 | 5/1974 | Fahey, Jr. | 280/37 |
| 3,842,953 | 10/1974 | Royet | 190/18 A |

*Primary Examiner*—Stephen P. Garbe

*Attorney, Agent, or Firm*—Wegner, Stellman, McCord, Wiles & Wood

[57] ABSTRACT

A combined luggage case and collapsible trolley includes storable collapsed trolley members which are telescopically slidable to hold additional luggage between the extended members and the luggage case. A foldable wheel assembly, storable within a wall of the luggage case, includes a sleeve which is rotatable about one of the extendable members, and slidable to a lockable position to provide additional clearance above ground. In one embodiment, the entire trolley framework is detachable from the luggage case and can be removed when the trolley feature is not desired.

16 Claims, 7 Drawing Figures

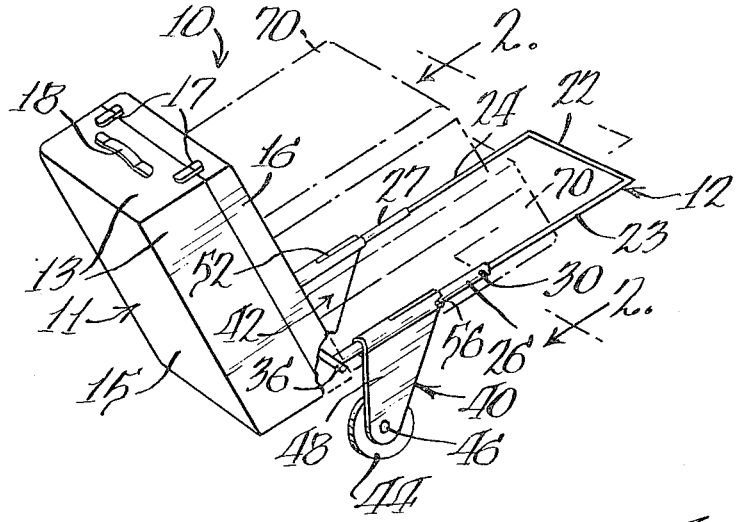
Fig. 1.
Fig. 2.
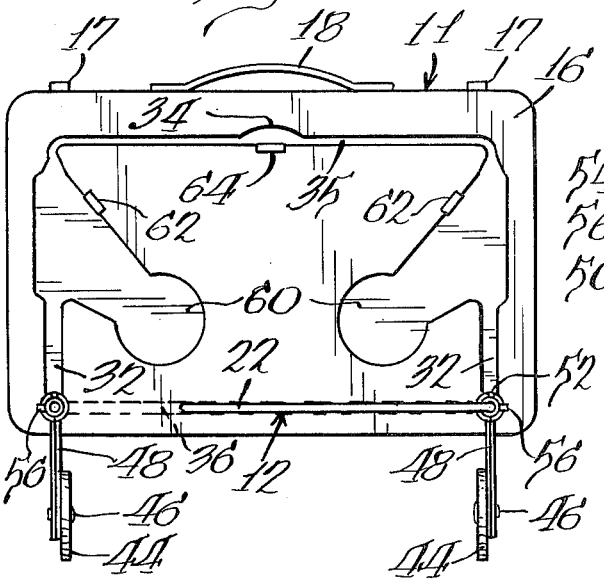
Fig. 3.
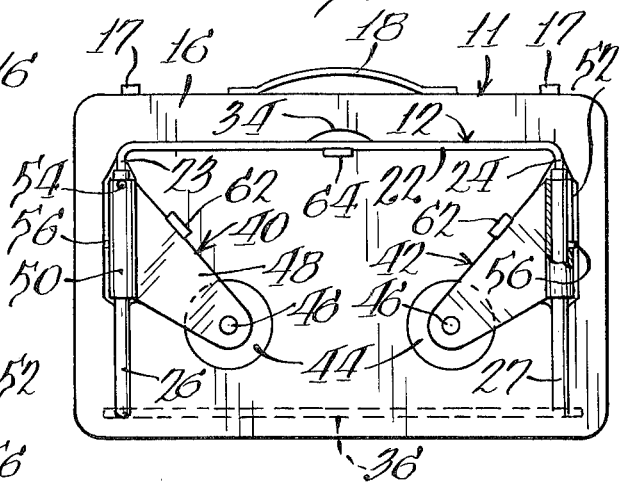
Fig. 4.
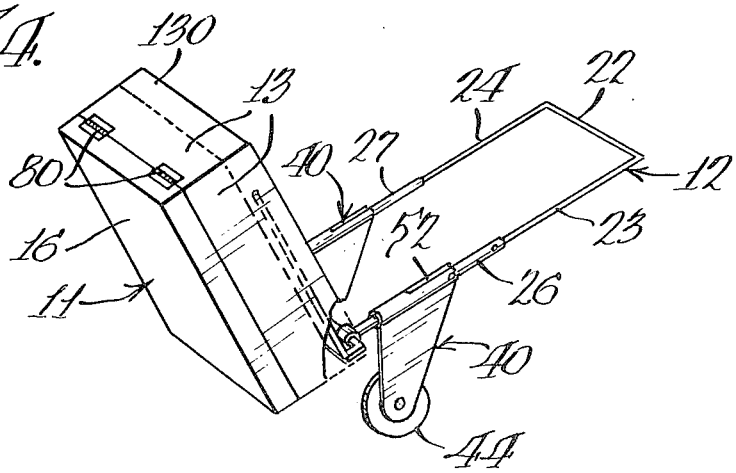

COLLAPSIBLE TROLLEY AND PORTABLE CASE

BACKGROUND OF THE INVENTION

This invention relates to a collapsible trolley associated with a portable case and adapted to retain luggage placed between the extended framework of the trolley and the portable case.

In my U.S. Pat. No. 3,709,513 issued Jan. 9, 1973. I have disclosed a collapsible trolley in which a portable case forms the foot of the trolley and an integral collapsible framework is pivotally attached to the portable case. The collapsible framework includes a handle and a pair of wheels which can be collapsed into a closed position located externally and at the sides of the portable case. When unfolded into an open position, the wheels project below the portable case and the framework projects outwardly from the case in a locked condition to form a wheeled trolley adapted to retain additional luggage between the framework and the portable case.

While the above collapsible trolley and integral portable case has many advantages, it would be desirable to produce a more compact structure and to incorporate the trolley structure solely within one face of the case to simplify manufacture. Depending on the size of the portable case, the wheel structure may not provide sufficient clearance above ground for all angles at which the trolley framework may be carted about by a user. Sometimes it may be desirable to use only the portable case, and not the collapsible trolley, and it would be advantageous to allow such dual use and thereby lighten the portable case when the trolley feature is not desired. Finally, use of the portable case as the foot of a trolley is not practical when the portable case is to be quite large. Other improvements in the appearance and portability of the assembly would be desirable.

SUMMARY OF THE INVENTION

In accordance with the present invention, all of the above noted problems have been overcome by improved embodiments for a combined luggage case and collapsible trolley. The collapsible trolley framework is storable solely within one face of the portable case. In particular, the collapsible trolley framework collapses into nesting members and lies flat within specially molded compartments formed in the lid or the bottom panel of the portable case. The wheel assembly is slidable and rotatable to a lockable operating position which provides additional clearance.

In one embodiment, the framework is easily separable from the portable case to enable the case to be carried without the framework, as for example when a traveler has a small amount of baggage which can be carried within the portable case, or which can be carried in additional luggage which can be easily transported without the need for a trolley. When the trolley feature is thus not likely to be used, the trolley framework can be detached from the case in order to reduce the weight of the portable case. This also reduces the cost of manufacture and assembly.

In another embodiment adapted to large luggage, the portable case forms the side of the trolley and has an integral or extendable handle located at one end thereof, and an extendable foot which can be opened in order to support additional luggage between the opened foot of the trolley and the large case.

One object of the present invention is the provision of a portable case and luggage trolley having improved mounting and trolley features for ease of manufacture, increased portability, improved security during transport, and the like.

Other features and advantages of the invention will be apparent from the following description and from the drawings. While illustrative embodiments of the invention are shown in the drawings and will be described in detail herein, the invention is susceptible of embodiment in many different forms and it should be understood that the present disclosure is to be considered as an exemplification of the principles of the invention and is not intended to limit the invention to the embodiments illustrated.

BRIEF DESCRIPTION OF THE DRAWINGS

FIG. 1 is a perspective view of a collapsible trolley framework storable within one face of a portable case, and illustrated in its extended open position;

FIG. 2 is a plan view taken along lines 2—2 of FIG. 1;

FIG. 3 is a plan view similar to FIG. 2 but illustrating the trolley framework collapsed and stored within the one face of the case;

FIG. 4 is a perspective view of another embodiment in which the trolley framework is detachable or separable from the portable case;

DESCRIPTION OF THE PREFERRED EMBODIMENTS

Figure 5:
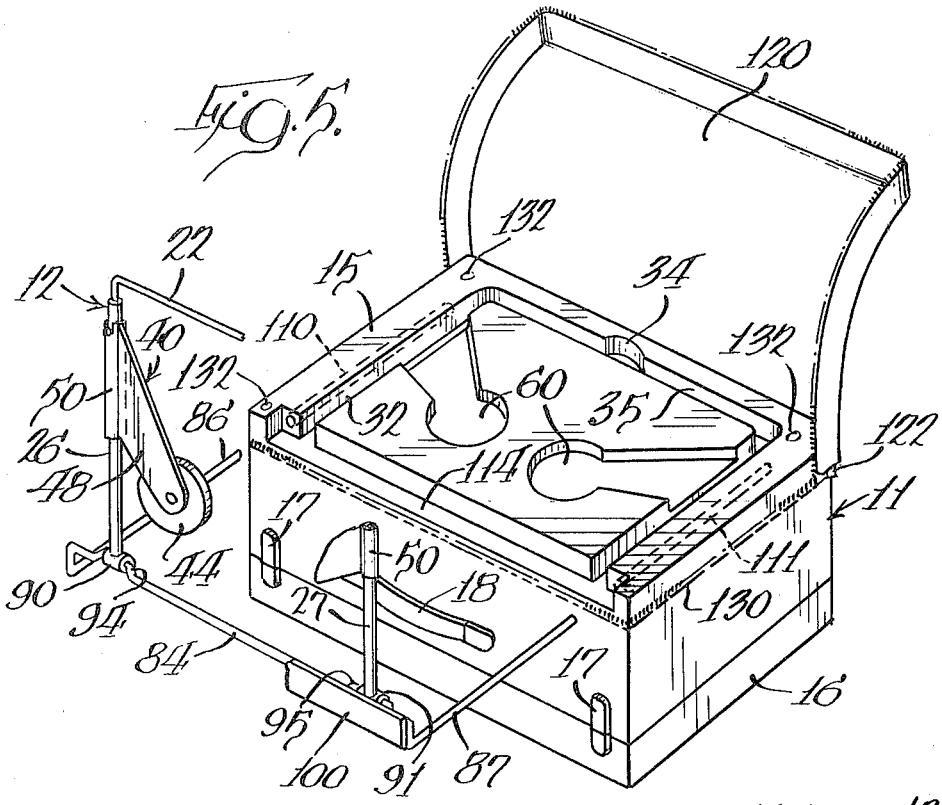
FIG. 5 is a different perspective view of the FIG. 4 embodiment and illustrating in more detail the removable trolley framework and portable case.

In FIGS 1–3 one embodiment of a novel combined collapsible trolley and portable case is illustrated. The trolley 10 comprises a portable case 11 and an extendable handle framework 12 which is pivotally hinged to the case. The case 11 forms an article holding container defined by a plurality of joined side walls 13, a bottom wall or face 15, and an openable wall or lid 16. A pair of luggage locks 17 may be opened to allow the lid 16 to be pivoted up in order to expose an open interior space for holding articles therein. A handle 18 allows the case 11 to be easily transported by hand when the trolley framework 12 is collapsed into and stored within the portable case, as during transport in a luggage compartment of a vehicle. The case 11 can be formed of any suitable material, but at least the lid 16 is desirably formed in part of a molded synthetic plastic material.

The trolley and handle framework 12 comprises an inverted U-shaped handle 22 having side arms 23 and 24 which are telescopically slidable within elongated cylindrical apertures having the same cross-section as the arms and located centrally within side shafts or bars 26 and 27, respectively. Locking means such as a biased detent pin 30 is provided on each side arm and is locatable in a detent hole in each side bar to lock the handle 22 in the extended position, as shown in FIG. 1.

The side bars 26 and 27 are pivotally attached to the lid 16 so that they can be swung from a collapsed or folded position, as illustrated in FIG. 3, in which they lie flat within molded recesses 32 formed in the lid 16. A finger indent 34 allows the traveler to grasp the handle 22, when it is folded flat into its molded recess 35, in order to pivot the handle and integral side bars through an angle of 90° into a position in which they extend perpendicular or normal from the top surface of the lid 16.

Preferably, the lid 16 is provided with a hinge or crossbar 36 which serves to strengthen the lid, and serves as the pivot hinge for the side bars 26 and 27. If desired, the crossbar 36 can pass through the opposite side walls 13 and side flaps of the lid 16, to serve as a hinge pin for hinging of the lid 16 to the portable case 11. Alternatively, the lid can be hinged to the case by separate hinge means (as shown in FIG. 4), and the side bars 26 and 27 could be pivotally attached to separate hinge means, or alternatively could be attached to a separate hinge pin molded in or otherwise attached to the lid 16.

Mounted on the side bars 26 and 27 are two wheel assemblies 40 and 42. Each assembly is identical, but of mirror image and each has a wheel 44 rotatably mounted by an axle 46 to a leg 48 having on its opposite end an integral sleeve 50. Each sleeve 50 has a cylindrical center aperture, FIG. 3, formed by a cylindrical wall having therein an elongated storing slot 52 and a substantially shorter locking slot 54. An extending pin 56 mounted on the side bar is locatable within one or the other of the slots 52 and 54, depending on whether the wheel assembly is in the stored position or in the trolley position, respectively. The cylindrical sleeves 50 are slidable and rotatable along the side bars 26 and 27 and lockable in the extended position shown in FIGS. 1 and 2.

To store the handle framework, each sleeve 50 is slid and rotated to align the associated elongated slot 52 with the pin 56, after which the sleeve 50 is urged toward the handle 22 until the pin 56 contacts the end of the slot 52. The handle 22 may now be telescoped into the side bars 26 and 27, and the entire mechanism pivoted into the lid 16.

A pair of wheel recesses 60 are formed in the lid 16 to allow the wheels to lie flat within the lid. Wheel clips 62 and a handle clip 64, may be provided to hold the wheel assembly and the handle within the molded recesses of the lid. If desired, in addition or in lieu of the clips, a cover such as illustrated in FIG. 5 may be provided to cover the trolley framework when in the collapsed position.

To use the trolley, the handle 22 is snapped out of its recess and rotated 90°, and then pulled so as to extend the telescoped side arms. The wheel assemblies are slid downwardly toward the lid until the pins 56 clear the elongated slots, and then rotated outwardly 90° and upwardly away from the lid to locate the pins 56 within the lock slots 54. Additional luggage 70, FIG. 1, may be then loaded on the trolley between the portable case 11, which serves as the foot of the trolley, to prevent the additional luggage from falling off, and the extended trolley framework 12. The additional luggage 70 will create a downwardly directed force which tends to open the angle between the face of the lid 16 and the side bars. If may therefore be necessary to stiffen and support the hinged joint between the side bars and the portable case. This can be done by supporting levers on the inside surface of the lid to reinforce and strengthen the lid.

If desired, a crossbar can be formed integral with side bars 26 and 27, adjacent the opening at which the side arms 23 and 24 are telescoped therein, to provide an additional support for smaller luggage which may be placed on the trolley. An additional molded recess would be formed in the lid, similar to the handled molded recess 35, and the wheel assembly would be offset from the handle when in the collapsed position to allow space for the crossbar.

It is not essential to form molded recesses in the lid 16 and various alternative means can be provided for attaching the trolley to the container. It will be seen that the portable case can be readily used either as the foot of a trolley, or as a portable luggage case. When the extendable framework 12 is folded flat within or against the lid, the lid 16 can be opened and the portable case can be used as a luggage container or suitcase in a conventional manner.

In FIGS. 4–5, another embodiment is illustrated showing a convertible luggage case in which the trolley framework is detachable or separable from the portable case. The same reference numerals as used in FIGS. 1-3 have been utilized for similar elements. Generally, the embodiment of FIGS. 4–5 is similar to the other embodiments except as concerns the mounting structure for detachably joining the collapsible trolley framework 12 to the portable case 11, and that the connection is made to the bottom side 15 of the suitcase, rather than to the lid. The lid 16 is mounted to the luggage container by conventional hinges 80. In use as a trolley, the portable case 11 is in the upside-down position with the lid 16 facing the ground. This has the advantage of substantially simplifying and reducing the weight of the lid, for ease in using the suitcase. Alternatively, the connecting mechanism could be formed as a part of the lid, as in the FIGS. 1–3 embodiment, so that the case would be in the upright position during use as a trolley.

The hinge and fastening structure for the trolley framework consists of a crossbar 84 having two integral, extending fastening means in the form or rib bars 86 and 87. The side bars 26 and 27 terminate in joints 90 and 91 which rotatably mount the handle framework about the crossbar 84. The crossbar 84 has two indented sections 94 and 95 which are rotatably journalled within the joints 90 and 91. A flat back plate 100 is attached to the crossbar 84 by any suitable means such as studs, screws, or by being welded thereto. When the handle framework is in its extended position, the back plate 100 forms a rigid stop for the side bars 26 and 27 to prevent the angle between the rib bars 86 and 87 and the side bars 26 and 27 from increasing when the trolley is loaded. The rib bars 86 and 87 are formed at a slightly lower level than the crossbar 84 so that when the handle framework is folded parallel to the rib bars, the framework is slightly raised from the plane of the rib bars.

The recesses in the bottom panel 15, for storage of and attachment to the trolley structure, are illustrated in FIG. 5. The side bar recesses 32, handle recess 35 and indent 34, and wheel recesses 60, are the same as in FIGS. 1–3. A detachable fastener, for mating engagement with rib bars 86 and 87, comprise a pair of elongated cylindrical bores or channels 110 and 111 which extend into the bottom panel parallel with the side bar recesses 32, and extend almost completely across the width of the suitcase. An open channel or groove 114 is formed in the front edge of the bottom panel to compactly locate the crossbar 84 and the back plate 100 therein when the trolley framework is attached to the suitcase. When the rib bars are pushed fully into the elongated channels, the back plate 100 covers the front edge of the bottom panel, and presents a pleasing appearance. Since the rib bars 86 and 87 are on a slightly lower plane than the crossbar 84, the rib bars are buried deeper in the bottom panel for greater strength.

A fabric cover 120 is permanently attached to the back side wall, and can be fastened by a zipper 122 around the remaining bottom wall. When the trolley framework is stored in the recesses, the cover secures the framework and presents a pleasing appearance in which the convertible portable case resembles a conventional suitcase. When the trolley framework is extended, the cover 120 may be partly zippered shut and the additional luggage laid thereagainst. If desired, two zippers may be used so that both sides may be closed, up to the extending side bars 26 and 27.

When use of the trolley feature is not contemplated, the handle structure 12 may be entirely separated or detached from the suitcase, in order to reduce the weight of the portable case, which may now be used as a conventional suitcase without the trolley feature. The rib bars 86 and 87 are slidably withdrawn from the capturing bores. The fabric cover 120 is then zippered shut so as to cover the bores and the recesses.

Different detachable fastening means may be utilized, as illustrated by the dashed lines in FIGS. 4 and 5. A separate bottom panel 130 can be detachably connected to the container by an elongated member, such as bolts 132, insertable into a mating fastening element in the container, such as elongated, threaded bores for receiving the bolts. In such a case, the collapsible framework itself need not be separable from the bottom panel 130, and could be manufactured as an integral unit pivotally attached to the panel as shown by the structure in FIGS. 1–3.

Other modifications may be made to the portable case and detachable trolley framework. The side legs 26 and 27 can be prevented from rotating too far about the crossbar 84 by means other than the back plate 100, eliminating the back plate. More than two strengthening rib bars 86 and 87 can be provided, if desired. To make the suitcase less bulky and to reduce the costs thereof, it may be desirable to eliminate the molded recesses and cause the handle framework 12 to fold down onto the flat surface of the case, and be retained in position by catches or other suitable attaching means.

Figure 6:
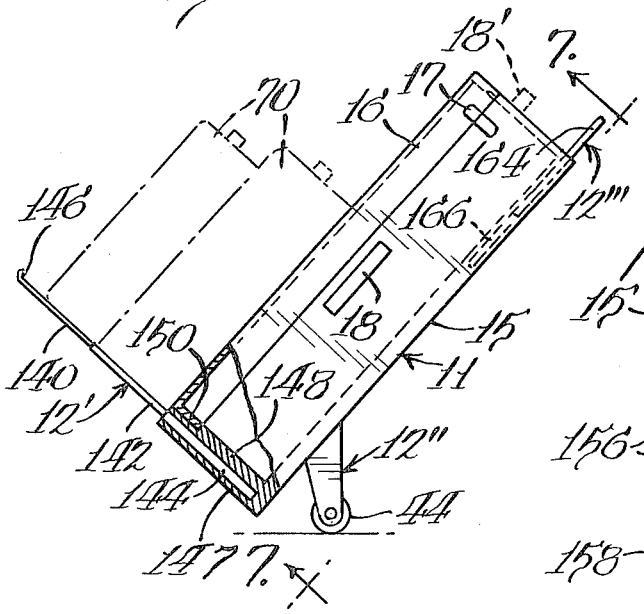
FIG. 6 is a side view of another embodiment in which a large portable case forms a side element of the trolley.
Figure 7:
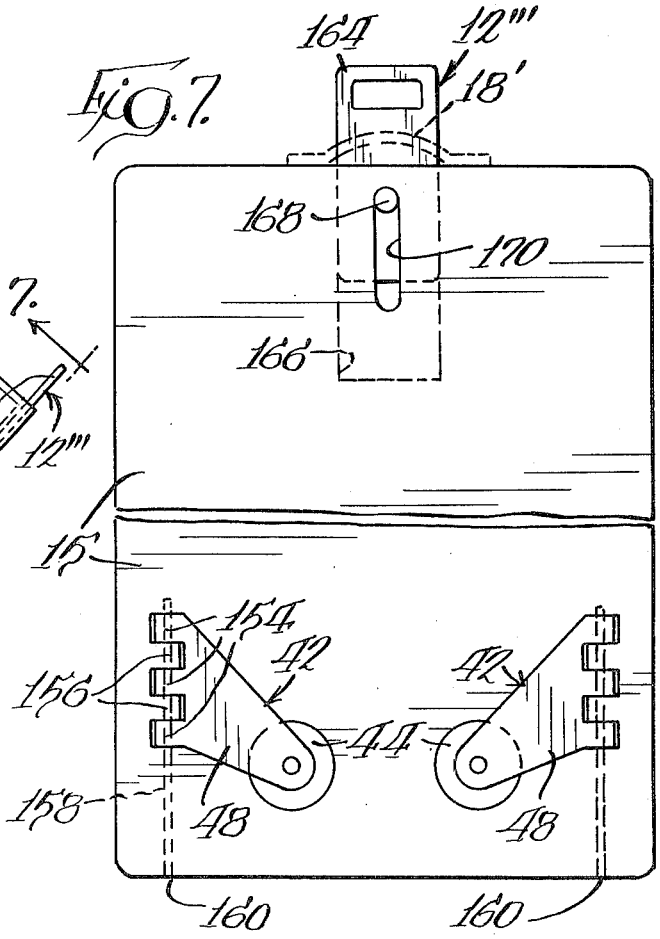
FIG. 7 is an enlarged, fragmentary plan view taken along lines 7—7 of FIG. 6.

In FIGS. 6 and 7, a third embodiment of the combined luggage case and collapsible trolley is illustrated in which a large luggage case is used as the side element of the trolley. Elements similar to previously described elements have been identified by the same reference numerals. The larger portable case 11 is oriented so that the length of the case serves as the side element of the trolley. The extendable trolley structure is formed of three separate portions 12′, 12″ and 12‴.

The trolley foot 12′ is formed by a flat plate 140 which is telescopically slidable into a mating recess in a plate 142, which in turn is telescopically slidable within a mating rectangular recess or pocket 144 located at one side of the portable case 11. The plates 140 and 142 are solid rectangular or webbed plates which form a central carrying member, as opposed to the spaced side arms and side bars as in the previous embodiments. A suitable finger hold 146 is formed at the end of plate 140 to allow the traveler to grasp the plate 140 when in its collapsed position within the pocket 144. The pocket 144 is formed by an external wall 146 which is separate from the side container wall 148. The lip 150 of lid 16 mates with the interior container wall 148 to cause the luggage structure to be independent of and separate from the trolley foot structure.

The wheel assemblies 12″ include segmented sleeves 154 which intermesh with guide sleeves 156 formed in the bottom panel 15 of the case, and which have coaxial bores for receiving a shaft or pivot rod 158 which extends therethrough. During assembly, the pivot rod 158 is inserted through a side opening 160 which may then be covered to secure the rod in place. The legs 48 and wheels 44 may be folded flat within recesses formed in the bottom panel 15, or rotated 90° to the position illustrated in FIG. 6, in order to open the wheel structure for use. The wheels may be retained in the operable position by frictional engagement, or due to any suitable detent mechanism.

The handle 12‴ is formed by a flat plate 164 which is slidably received within a rectangular pocket 166 located within the back panel 15. A pin 168, extending from the plate 164, is received within an elongated slot 170, the ends of which serve as stops for the extended and stored positions of the handle. The extended length of the plate 164 is selected so as to allow the traveler to comfortably cart or wheel the luggage case 11 when used as a trolley. While use of an extendable handle 164 is desirable for ease of transporting the trolley, and for adapting the trolley to different sizes of luggage cases, it will be appreciated that a permanent auxiliary handle 18′ could be located on the side of the suitcase for this purpose. Desirably, the auxiliary handle 18′ would be in addition to handle 18, and would be advantageous due to the large size of the luggage case.

Various modifications can be made to the large luggage trolley, such as the addition of a cover for the wheel structure, if desired. Also, the various features shown for the different embodiments may be combined differently and used with other embodiments to provide similar features therefore. While the portable case has been illustrated as being an article holding container it will be appreciated that the portable case could be used solely to store the trolley structure. This would allow the case to be substantially smaller, on the order of a briefcase or attache case, and the traveler could hand carry the case onto vehicles after the additional luggage cases were delivered to the luggage compartments of the vehicles. Other changes will be apparent in view of the above teachings.

I claim:

1. In a combined collapsible trolley and portable case having a collapsible framework which can be extended from the case to form a wheeled trolley which is adapted to retain luggage placed between the extended framework and the case, the improvement comprising:

an extendable element pivotally attached to one face of the case for storage flat against the one face and for pivotal rotation outward to retain luggage placed between the extendable element and the one face, a wheel assembly storable against the one face of the case and with a sleeve slidable on the extendable element between a stored position when the extendable element is stored flat against the one face and a trolley position which provides additional clearnace above the ground, and a recess located on the one face for storing the wheel assembly and the entire collapsible framework.

2. The improvement of claim 1 wherein the sleeve includes lock means for locking the sleeve against rotation and sliding movement when in the trolley position.

3. The improvement of claim 1 wherein the collapsible framework includes a handle connected to a terminating end of the extendable element, the wheel assembly rotatably mountable on the extended element for rotation to a trolley position when the element is extended, and the recess means located within the one face stores the extendable element and associated handle and wheel assembly.

4. The improvement of claim 1 wherein the wheel assembly includes a pair of sleeves each having an extending leg rotatably mounting a wheel thereto, a pair of wheel recesses being located within said one face of the case, and a pair of extendable elements mounting the pair of sleeves for rotatable movement to allow both legs and associated wheels to be folded flat against said one face and within the pair of wheel recesses.

5. In a combined collapsible trolley and portable case having a collapsible framework which can be extended from the case to form a wheeled trolley which is adapted to retain luggage placed between the extended framework and the case, the improvement comprising:

the portable case includes a plurality of side walls and a bottom wall joined to form a luggage container and further having a lid hinged to a side wall and openable to allow articles to be placed within the container, a trolley element pivotally attached to the lid for storage within a recess in the lid and for pivotal rotation outward from the lid when the element is to support luggage placed between the extended element and the lid, and a wheel assembly storable within a recess in the lid and connected to the trolley element for extension therewith to form the wheeled trolley.

6. The improvement of claim 5 including a crossbar for pivotally connecting the lid to the side walls of the container and forming a hinge for the lid, the crossbar also being connected to the extendable element to form the pivotal connection therefore.

7. In a combined collapsible trolley and portable case having a collapsible framework which can be extended from the case to form therewith a trolley for retaining therebetween additional luggage, the improvement comprising:

the collapsible framework includes a trolley element extendable to form a support for the additional luggage, a member pivotally attached to one face of the case for storage flat against the one face or pivotal rotation outward therefrom, the member having an elongated aperture, and the extendable trolley element being telescopically slidable within the elongated aperture of the member for telescopic retraction when the trolley framework is to be stored and telescopic extension when the trolley is to be utilized, whereby the member when rotated outward from the one face and the telescopically extendable trolley element together form one side of the trolley.

8. The improvement of claim 7 wherein the pivoted member carries a wheel assembly having a sleeve rotatably mounted to the member, the wheel assembly including an extending leg for rotatably mounting a wheel.

9. The improvement of claim 7 wherein the trolley element includes a handle located on an end opposite the end which is telescopically slidable within the pivoted member, and the portable case includes a recess located within the one face for storing therein the handle and telescopically retracted trolley element and the pivoted member.

10. A convertible luggage case for holding articles and adaptable to cart additional luggage cases, comprising:

container means formed by a plurality of walls defining an interior space for holding articles therein, one of the walls being a lid which can be opened to insert articles into the interior space, and container fastening means on the container means, a detachable trolley framework having trolley fastening means for mating engagement with the container fastening means when the container means is to be used as a trolley and for detachment when the container means is to be used as a luggage case within the trolley feature, including an extendable trolley element adapted when extended to hold additional luggage between the extendable element and the container means, and a cover attached to the container means and encompassing the container fastening means and the trolley framework when in mating engagement with the container fastening means, whereby the cover is closable for covering the trolley framework when the trolley element is collapsed and is closable to cover the container fastening means when the trolley framework has been detached.

11. The convertible luggage case of claim 10 wherein the container fastening means comprises at least one interior bore in the container means and having an external opening, and the trolley fastening means includes a member insertable into the bore for detachable connection of the framework to the container means.

12. The convertible luggage case of claim 17 wherein the detachable trolley framework comprises a separable panel for containing the extendable trolley element and carrying the trolley fastening means, the panel being detachably connectable to the container fastening means.

13. The convertible luggage case of claim 12 wherein the panel is of the same size as one of the walls of the container means and includes recess means for storing a wheel assembly and a handle assembly therein, the handle assembly being extendable away from the wheel assembly when additional luggage cases are to be carted.

14. The convertible luggage case of claim 11 wherein the internal bore comprises an elongated cylindrical bore extending for a substantial portion of one wall of the container means, and the insertable member comprises an elongated rod slidable within the elongated cylindrical bore for attaching the trolley framework to the container means.

15. The convertible luggage case of claim 14 wherein the elongated rod has an integral crossbar connected to a portion which is external to the rod when inserted in the bore, the trolley framework includes a side bar having a joint for rotatable connection of the side bar to the crossbar, a handle element telescopically slidable within the side bar and rotatable with the side bar for movement into a recess formed on the one face of the container means for compact storage of the trolley framework when not in use.

16. The convertible luggage case of claim 15 wherein the trolley framework includes a wheel assembly having a sleeve rotatably mounted to the side bar, and the one wall of the container means contains a wheel recess for storing the wheel therein when the side bar and telescoped handle are located within the one face of the container means.

* * * * *